US007073675B2

(12) United States Patent
Trude

(10) Patent No.: US 7,073,675 B2
(45) **Date of Patent: *Jul. 11, 2006**

(54) CONTAINER WITH DEFLECTABLE PANELS

(75) Inventor: Greg Trude, Seven Valleys, PA (US)

(73) Assignee: Graham Packaging Company, B.B., York, PA (US)

( * ) Notice: Subject to any disclaimer, the term of this patent is extended or adjusted under 35 U.S.C. 154(b) by 262 days.

This patent is subject to a terminal disclaimer.

(21) Appl. No.: 10/682,023

(22) Filed: Oct. 10, 2003

(65) Prior Publication Data

US 2004/0159628 A1 Aug. 19, 2004

Related U.S. Application Data

(63) Continuation-in-part of application No. 10/366,617, filed on Feb. 14, 2003, now Pat. No. 6,935,525.

(51) Int. Cl.
*B65D 1/02* (2006.01)
*B65D 1/42* (2006.01)
*B65D 90/02* (2006.01)

(52) U.S. Cl. ..... 215/381; 215/384; 215/900; 220/666; 220/669; 220/675

(58) Field of Classification Search ..... 215/381, 215/383, 384, 900, 382, 398; 220/666, 669, 220/671, 675, 771
See application file for complete search history.

(56) References Cited

U.S. PATENT DOCUMENTS 4,372,455 A 2/1983 Cochran
4,497,855 A 2/1985 Agrawal et al.
4,805,788 A 2/1989 Akiho
4,877,141 A 10/1989 Hayashi et al.
5,141,120 A 8/1992 Brown et al.
5,141,121 A 8/1992 Brown et al.
5,178,290 A 1/1993 Ota et al.
5,238,129 A 8/1993 Ota
D344,457 S 2/1994 Prevot et al.
5,303,834 A 4/1994 Krishnakumar et al.
5,337,909 A 8/1994 Vailliencourt
5,341,946 A * 8/1994 Vailliencourt et al. ..... 215/381
5,392,937 A 2/1995 Prevot et al.

(Continued)

FOREIGN PATENT DOCUMENTS

JP 405065158 A 3/1993

(Continued)

*Primary Examiner*—Sue A. Weaver
(74) *Attorney, Agent, or Firm*—Venable, LLP; James R. Burdett; Jeffri A. Kaminski

(57) ABSTRACT

A container includes an enclosed base portion. A body portion extends upwardly from the base portion. The body portion includes a central longitudinal axis and at least six deflectable panels. The deflectable panels have side edges extending in the direction of the longitudinal axis. A top portion with a finish extending upwardly from the body portion is provided. A first indentation is disposed between the body portion and the top portion and extends for 360 degrees around the container. The first indentation is offset towards the central longitudinal axis with respect to the deflectable panels. A second indentation is disposed between the body portion and the base portion and extends for 360 degrees around the container. The indentations are offset towards the central longitudinal axis with respect to the deflectable panels.

35 Claims, 4 Drawing Sheets

U.S. PATENT DOCUMENTS

| | | | | |
|---|---|---|---|---|
| D366,416 | S | 1/1996 | Semersky | |
| D366,417 | S | 1/1996 | Semersky | |
| D366,831 | S | 2/1996 | Semersky | |
| 5,908,128 | A | 6/1999 | Krishnakumar et al. | |
| 5,971,184 | A | 10/1999 | Krishnakumar et al. | |
| 6,935,525 | B1 * | 8/2005 | Trude | 215/381 |
| 2003/0000911 | A1 * | 1/2003 | Kelley et al. | 215/381 |
| 2003/0015491 | A1 * | 1/2003 | Melrose et al. | 215/381 |

FOREIGN PATENT DOCUMENTS

| | | |
|---|---|---|
| WO | WO 00/50309 | 8/2000 |
| WO | WO 00/68095 | 11/2000 |

* cited by examiner

CONTAINER WITH DEFLECTABLE PANELS

CROSS-REFERENCE TO RELATED APPLICATIONS

This application is a continuation-in part of U.S. patent application Ser. No. 10/366,617 entitled "Container with Flexible Panels", filed Feb. 14, 2003 U.S. Pat. No. 6,935,525 and which is incorporated herein by reference.

BACKGROUND OF THE INVENTION

1. Field of the Invention

The present invention generally relates to a pressure-adjustable container, and more particularly to such containers that are typically made of polyester and are capable of being filled with hot liquid. It also relates to an improved sidewall construction for such containers.

2. Related Art

The use of blow molded plastic containers for packaging "hot fill" substances is well known. However, a container that is used for hot fill applications is subject to additional mechanical stresses on the container that result in the container being more likely to fail during storage or handling. For example, it has been found that the thin sidewalls of the container deform or collapse as the container is being filled with hot fluids. In addition, the rigidity of the container decreases immediately after the hot fill liquid is introduced into the container. As the liquid cools, the liquid shrinks in volume which, in turn, produces a negative pressure or vacuum in the container. The container must be able to withstand such changes in pressure without failure.

Hot fill containers typically comprise substantially rectangular vacuum panels that are designed to collapse inwardly after the container has been filled with hot liquid. However, the inward flexing of the panels caused by the hot fill vacuum creates high stress points at the top and bottom edges of the panels, especially at the upper and lower corners of the panels. These stress points weaken the portions of the sidewall near the edges of the panels, allowing the sidewall to collapse inwardly during handling of the container or when containers are stacked on top of each other. See, for example, U.S. Pat. No. 5,337,909.

"Hot-fill" applications impose significant and complex mechanical stress on a container structure due to thermal stress, hydraulic pressure upon filling and immediately after capping, and vacuum pressure as the fluid cools.

Thermal stress is applied to the walls of the container upon introduction of hot fluid. The hot fluid causes the container walls to soften and then shrink unevenly, causing distortion of the container. The polyester typically used to form the container must therefore be heat-treated to induce molecular changes resulting in a container that exhibits thermal stability. Pressure and stress are acted upon the sidewalls of a heat resistant container during the filling process, and for a significant period of time thereafter. When the container is filled with hot liquid and sealed, there is an initial hydraulic pressure and an increased internal pressure is placed upon containers. As the liquid, and the air headspace under the cap, subsequently cool, thermal contraction results in partial evacuation of the container. The vacuum created by this cooling tends to mechanically deform the container walls.

Generally speaking, containers incorporating a plurality of longitudinal flat surfaces accommodate vacuum force more readily. Agrawal et al, U.S. Pat. No. 4,497,855 discloses a container with a plurality of recessed collapse panels, separated by land areas, which allows uniformly inward deformation under vacuum force. The vacuum effects are controlled without adversely affecting the appearance of the container. The panels are drawn inwardly to vent the internal vacuum and so prevent excess force being applied to the container structure, which would otherwise deform the inflexible post or land area structures. The amount of "flex" available in each panel is limited, however, and as the limit is approached there is an increased amount of force that is transferred to the side walls.

The flexure is most commonly addressed with vacuum flex panels positioned under a label below the dome of the container. One example of containers having such vacuum flex panels is disclosed in U.S. Pat. No. 5,141,120 (Brown et al.) and U.S. Pat. No. 5,141,121 (Brown et al.), each of which is incorporated by reference. In such patents, pinch grip indentations function as the vacuum flex panels. Another example of containers having such vacuum flex panels is disclosed in U.S. Pat. No. 5,392,937 (Prevot et al.) and Des. Pat. No. 344,457 (Prevot et al.), both of which are assigned to the assignee of the present invention and hereby incorporated by reference. In those containers, a grip structure moves with the vacuum flex panel in response to a vacuum induced inside the container in response to hot filling, capping and cooling of the container contents. Still another example of containers having such vacuum flex panels is disclosed in International Publication No. WO 00/50309 (Melrose), which is incorporated herein by reference. With that container, a controlled deflection vacuum flex panel inverts and flexes under pressure to avoid deformation and permanent buckling of the container. It includes an initiator portion, which has a lesser projection than the remainder of the flex panel and initiates deflection of the flex panel.

External forces are applied to sealed containers as they are packed and shipped. Filled containers are packed in bulk in cardboard boxes, or plastic wrap, or both. A bottom row of packed, filled containers may support several upper tiers of filled containers, and potentially, several upper boxes of filled containers. Therefore, it is important that the container have a top loading capability, which is sufficient to prevent distortion from the intended container shape. Dome region ovalization is a common distortion associated with hot-fillable, blow-molded plastic containers. The dome is the upper portion of the container adjacent the finish. Some dome configurations are designed to have a horizontal cross-section which is circular in shape. The forces resulting form hot-filling and top loading can change the intended horizontal cross-sectional shape, for example, from circular to oval.

Examples of hot-fillable, blow-molded plastic containers that can withstand the above referenced forces and can maintain their as-designed aesthetic appearance are the containers disclosed in U.S. Pat. Nos. Des. 366,416, Des. 366,417, and Des. 366,831 all assigned to the assignee of the present application and incorporated herein by reference. The referenced design patents illustrate in phantom lines a "bell-shape" dome located between a finish and a label mounting area. The diameter of the horizontal cross-section through a bell-shaped dome increases as the dome extends downwardly from the finish. The dome diameter then decreases to an inwardly extending peripheral waist, and downwardly from the waist, the dome diameter increases before connecting with the label mounting area of the container. The bell-shape of the dome provides an aesthetic appearance as initially blow-molded, and it provides a degree of reinforcement against distortion of the dome, particularly ovalization types of distortion.

To minimize the effect of force being transferred to the side walls, much prior art has focused on providing stiffened regions to the container, including the panels, to prevent the structure yielding to the vacuum force. The provision of horizontal or vertical annular sections, or 'ribs', throughout a container has become common practice in container construction, and is not only restricted to hot-fill containers. Such annular sections will strengthen the part they are deployed upon. U.S. Pat. No. 4,372,455 (Cochran) discloses annular rib strengthening in a longitudinal direction, placed in the areas between the flat surfaces that are subjected to inwardly deforming hydrostatic forces under vacuum force. U.S. Pat. No. 4,805,788 (Ota et al.) discloses longitudinally extending ribs alongside the panels to add stiffening to the container. Ota also discloses the strengthening effect of providing a larger step in the sides of the land areas. This provides greater dimension and strength to the rib areas between the panels.

U.S. Pat. No. 5,178,290 (Ota et al.) discloses indentations to strengthen the panel areas themselves. U.S. Pat. No. 5,238,129 (Ota et al.) discloses further annular rib strengthening, this time horizontally directed in strips above and below, and outside, the hot-fill panel section of the bottle. In addition to the need for strengthening a container against both thermal and vacuum stress, there is a need to allow for an initial hydraulic pressure and increased internal pressure that is placed upon a container when hot liquid is introduced followed by capping. This causes stress to be placed on the container side wall. There is a forced outward movement of the heat panels, which can result in a barreling of the container.

Thus, U.S. Pat. No. 4,877,141 (Hayashi et al.) discloses a panel configuration that accommodates an initial, and natural, outward flexing caused by internal hydraulic pressure and temperature, followed by inward flexing caused by the vacuum formation during cooling. Importantly, the panel is kept relatively flat in profile, but with a central portion displaced slightly to add strength to the panel but without preventing its radial movement in and out. With the panel being generally flat, however, the amount of movement is limited in both directions. By necessity, panel ribs are not included for extra resilience, as this would prohibit outward and inward return movement of the panel as a whole.

U.S. Pat. No. 5,908,128 (Krishnakumar et al.) discloses another flexible panel that is intended to be reactive to hydraulic pressure and temperature forces that occur after filling. Relatively standard 'hot-fill' style container geometry is disclosed for a "pasteurizable" container. It is claimed that the pasteurization process does not require the container to be heat-set prior to filling, because the liquid is introduced cold and is heated after capping. Concave panels are used to compensate for the pressure differentials. To provide for flexibility in both radial outward movement followed by radial inward movement however, the panels are kept to a shallow inward-bow to accommodate a response to the changing internal pressure and temperatures of the pasteurization process.

The increase in temperature after capping, which is sustained for some time, softens the plastic material and therefore allows the inwardly curved panels to flex more easily under the induced force. It is disclosed that too much curvature would prevent this, however. Permanent deformation of the panels when forced into an opposite bow is avoided by the shallow setting of the bow, and also by the softening of the material under heat. The amount of force transmitted to the walls of the container is therefore once again determined by the amount of flex available in the panels, just as it is in a standard hot-fill bottle. The amount of flex is limited, however, due to the need to keep a shallow curvature on the radial profile of the panels. Accordingly, the bottle is strengthened in many standard ways.

U.S. Pat. No. 5,303,834 (Krishnakumar et al.) discloses still further "flexible" panels that can be moved from a convex position to a concave position, in providing for a "squeezable" container. Vacuum pressure alone cannot invert the panels, but they can be manually forced into inversion. The panels automatically "bounce" back to their original shape upon release of squeeze pressure, as a significant amount of force is required to keep them in an inverted position, and this must be maintained manually. Permanent deformation of the panel, caused by the initial convex presentation, is avoided through the use of multiple longitudinal flex points.

U.S. Pat. No. 5,971,184 (Krishnakumar et al.) discloses still further "flexible" panels that claim to be movable from a convex first position to a concave second position in providing for a grip-bottle comprising two large, flattened sides. Each panel incorporates an indented "invertible" central portion. Containers such as this, whereby there are two large and flat opposing sides, differ in vacuum pressure stability from hot-fill containers that are intended to maintain a generally cylindrical shape under vacuum draw. The enlarged panel side walls are subject to increased suction and are drawn into concavity more so than if each panel were smaller in size, as occurs in a 'standard' configuration comprising six panels on a substantially cylindrical container. Thus, such a container structure increases the amount of force supplied to each of the two panels, thereby increasing the amount of flex force available. Even so, the convex portion of the panels must still be kept relatively flat, however, or the vacuum force cannot draw the panels into the required concavity.

The need to keep a shallow bow to allow flex to occur was previously described by Krishnakumar et al. in both U.S. Pat. No. 5,303,834 and U.S. Pat. No. 5,908,128. This, in turn, limits the amount of vacuum force that is vented before strain is placed on the container walls. Further, it is generally considered impossible for a shape that is convex in both the longitudinal and horizontal planes to successfully invert, anyhow, unless it is of very shallow convexity. Still further, the panels cannot then return back to their original convex position again upon release of vacuum pressure when the cap is removed if there is any meaningful amount of convexity in the panels. At best, a panel will be subject to being "force-flipped" and will lock into a new inverted position. The panel is then unable to reverse in direction as there is no longer the influence of heat from the liquid to soften the material and there is insufficient force available from the ambient pressure. Additionally, there is no longer assistance from the memory force that was available in the plastic prior to being flipped into a concave position.

U.S. Pat. No. 5,908,128 (Krishnakumar et al.) previously disclose the provision of longitudinal ribs to prevent such permanent deformation occurring when the panel arcs are flexed from a convex position to one of concavity. This same observation regarding permanent deformation was also disclosed in U.S. Pat. No. 5,303,834 (Krishnakumar et al.). U.S. Pat. No. 4,877,141 (Hayashi et al.) also disclosed the necessity of keeping panels relatively flat if they were to be flexed against their natural curve.

Thus, previous hot-fill containers usually include horizontal or vertical annular sections or 'ribs', to provide stiffness and increase structural support. These additional support structures create crevices and recesses in the interior of the container. When the container stores a viscous substance, such as jelly, jam, preserves, or heavy syrup, the viscous substance may become trapped in these crevices and recesses. Accordingly, a consumer may have difficulty accessing and removing a viscous substance from the container.

Other containers using panels as sidewalls for the container are typically four-sided containers. The junctions between the sidewalls form sharp angles in which the viscous substance stored in the container may become trapped and from which is difficult for a consumer to remove the viscous substance.

Embodiments of the present invention in contrast, allows for increased flexing of the vacuum panel sidewalls so that the pressure on the containers may be more readily accommodated, while providing a number a number of side walls to eliminating geometry inside of the container in order to facilitate product removal. Additionally, the container is provided with a more circular cross-section that can increase an internal volume of the container and allow for a wide variety of labeling options.

SUMMARY OF THE INVENTION

In an exemplary embodiment of the present invention, a container is disclosed. The container may be a hot-fill container having an improved geometry. The container has a shape that allows easy removal of a substance stored therein, while still accommodating the negative pressure associated with the hot fill process. The exemplary container has a central longitudinal axis and includes at least one deflectable panel. The deflectable panel projects from the longitudinal axis to pass through at least three curves, including a first curve having a first constant radius, a second curve having a second varying radius, and a third curve having a third constant radius that is greater than the first radius. At least one indented portion is arranged adjacent to and above or below the deflectable panels. The indented portion may extend around a perimeter of the container.

In another exemplary embodiment, the container comprises an enclosed base portion. A body portion extends upwardly from the base portion. The body portion has a central longitudinal axis and a plurality of active surfaces. A top portion has a finish extending upwardly from the body portion. A support portion is arranged in between one of the body and the top portion and the body and the base portion. The support portion is indented towards the central longitudinal axis with respect to at least one of the active surfaces, the body and the top portion.

According to another exemplary embodiment, the container comprises an enclosed base portion. A body portion extends upwardly from the base portion. The body portion has a central longitudinal axis and at least six deflectable panels. The deflectable panels have side edges extending in the direction of the longitudinal axis. A top portion with a finish extending upwardly from the body portion is provided. A first indentation is disposed between the body portion and the top portion and extends for 360 degrees around the container. The first indentation is offset towards the central longitudinal axis with respect to the deflectable panels. A second indentation is disposed between the body portion and the base portion and extends for 360 degrees around the container. The second indentation is offset towards the central longitudinal axis with respect to the deflectable panels.

Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of a preferred embodiment of the invention, as illustrated in the accompanying drawings.

DETAILED DESCRIPTION OF AN EXEMPLARY EMBODIMENT OF THE PRESENT INVENTION

A preferred embodiment of the invention is discussed in detail below. While specific exemplary embodiments are discussed, it should be understood that this is done for illustration purposes only. A person skilled in the relevant art will recognize that other components and configurations can be used without parting from the spirit and scope of the invention.

Figure 2:
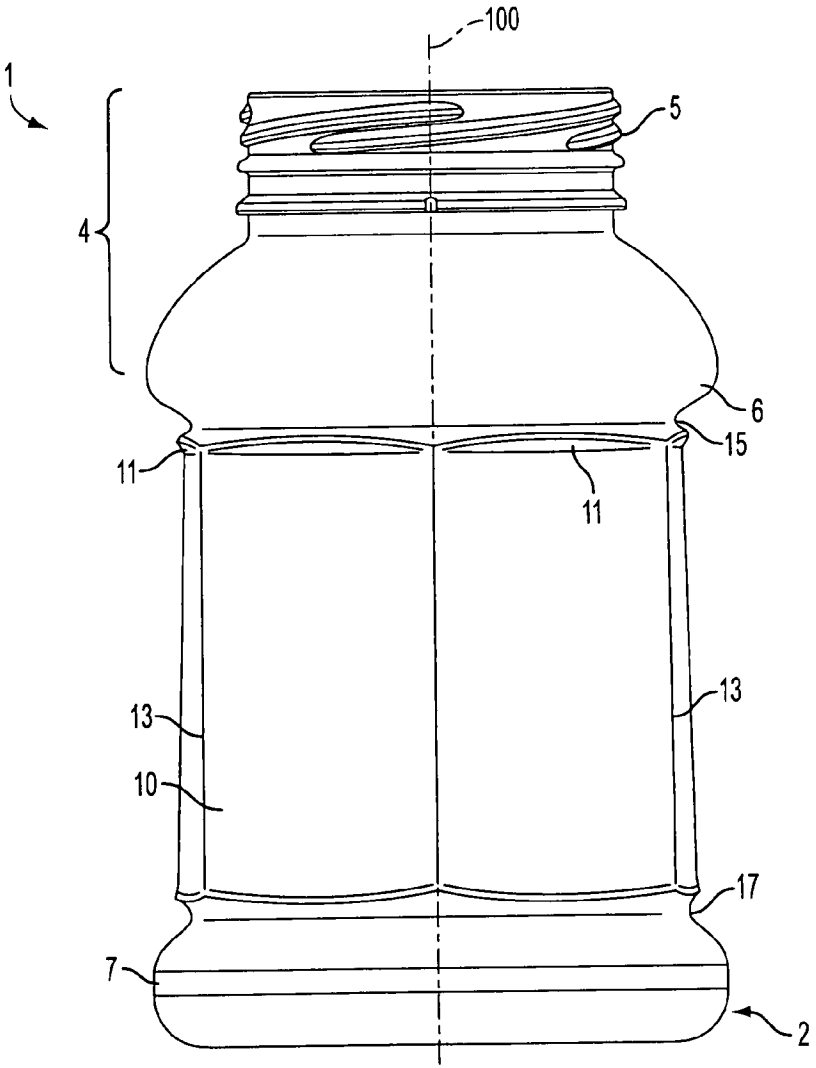
FIG. 2 depicts a side view of an exemplary embodiment of a container according to the present invention.
Figure 1:
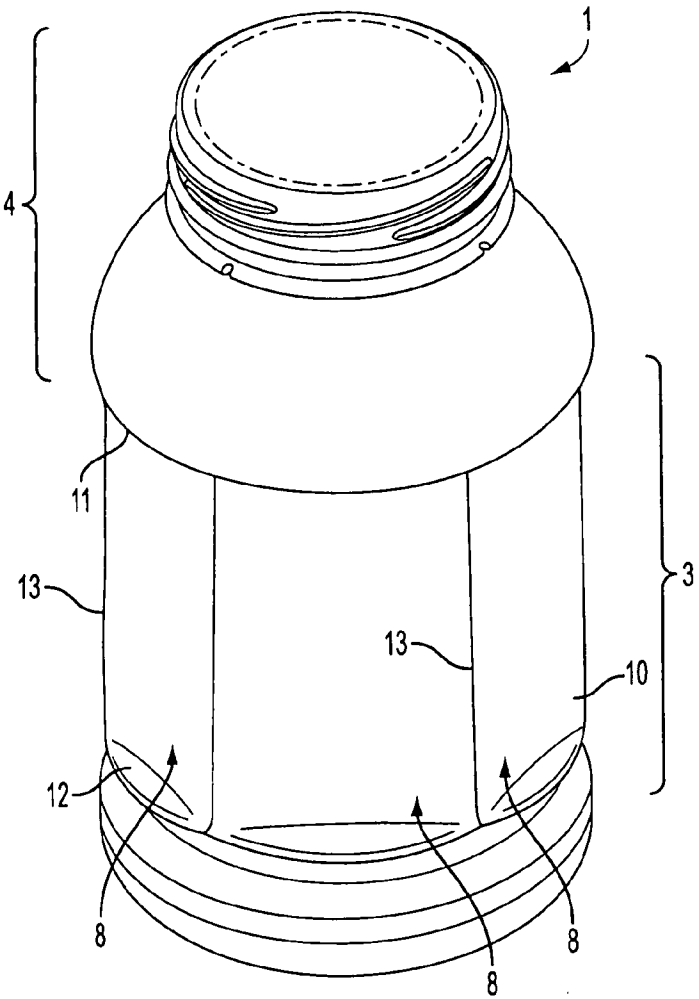
FIG. 1 depicts an isometric view of an exemplary embodiment of a container according to the present invention.

Referring now to the drawings, a preferred embodiment of a container incorporating flexible side panels is indicated generally in FIGS. 1 and 2, as generally having many of the well known features of hot-fill containers. The container 1 comprises a base 2 for supporting the container 1. The container 1 has a longitudinal axis 100 when the container 1 is standing upright on its base 2. A body 3 extends upwardly from the base 2.

A top portion 4 finishes upwardly from the body 3 and may include a threaded neck 5 for filling and dispensing fluid. Neck 5 also is sealable with a cap (not shown). The preferred container further comprises a first shoulder 6 located below neck 2 and above body 3 and a second shoulder 7 located above base 2 and below body 3. Roughly rectangular sides 8 that connect top portion 4 and base 2 define the body 3.

The container 1 is preferably a pressure-adjustable container, in particular a 'hot-fill' container that is adapted to be filled with a liquid or other substance at a temperature above room temperature. The container 1 may be formed in a blow mold and may be produced from a polyester or other plastic material, such as a heat set polyethylene terepthalate (PET). Generally, the body comprises at least one vacuum or flexible panel 10. In the embodiment shown in FIGS. 1 and 2, the sides 8 are each substantially comprised of flexible panels 10. Each flexible panel 10 may be generally rectangular in shape and is adapted to flex inwardly upon filling the container with a hot-fill liquid, capping the container, and subsequent cooling of the liquid. During the hot fill process the flexible panel 10 operates to compensate for the hot-fill vacuum.

In the embodiment illustrated in FIGS. 1 and 2, the body 3 includes six flexible panels (only three of which are visible). The panels are arranged next to each other around the body 3. Accordingly, the body 3 may suitably comprise a hollow body with the panels forming sides of the body. By providing a body comprised of more than four panels, the shape of the body 3 can be made more circular. A body 3 comprised of six or more panels formed around the body has a cross section in a plane perpendicular to the longitudinal axis 100 that is substantially circular. Alternatively, any number of flexible panels 10 may be provided and the body may have any other suitable shape.

A container having a substantially circular cross section has several advantages over a container having a cross-section with sharp corners, such as a four-sided container with a rectangular cross-section. For example a viscous substance tends to collect in the sharp corners of a four-sided container. It is difficult for a consumer to remove a substance from the corners. In comparison, circular containers do not typically have this problem. Furthermore, increasing the number of panels to make the container more circular can also increases the volume of the container without any corresponding increase in the footprint of the container.

The flexible panels 10 preferably comprise the entire area of the sides 8. As shown in FIGS. 1 and 2, the panels 10 have a top edge 11, a bottom edge 12, and side edges 13. Side edges 13 of the flexible panels 10 extend vertically along the longitudinal axis of the container. Side edges 13 of each panel 10 smoothly merge with side edges 13 of adjacent flexible panels. A support post or column may be formed at the junction between side edges 13 of adjacent panels 11. The support post provides additional structural support and increases the container's ability to withstand top load forces. Adjacent flexible panels 10 should be joined with each other via a rounded or smooth edge. Preferably, no other geometry is present in the body 3 except for flexible panels 10 and their junctions with each other.

The container 1 may also include an indented portion. The indented portion is preferably formed adjacent to the flexible panels. The indented portion can prevent the container from becoming oval at the top portion and/or at the base. In the embodiment illustrated in FIGS. 1 and 2, first 15 and second 17 indented portions are provided. The first indented portion 15 is arranged in between the first shoulder 6 of top portion 4 and top edge 11 of the panels 10. The first indented portion 15 is offset towards the longitudinal axis 100 of the container with respect to at least one of the first shoulder 6 and the panels 10. The first indented portion 15 merges smoothly with the first shoulder 6 and the top edge 11 of the panels 10. Second indented portion 17 is arranged in between the second shoulder 7 of base 2 and bottom edge 12 of the panels 10. The second indented portion 17 is offset towards the longitudinal axis of the container with respect to at least one of the second shoulder 7 and the panels 10. The second indented portion 17 merges smoothly with the second shoulder 6 and the bottom edge 12 of the panels 10.

Figure 3:
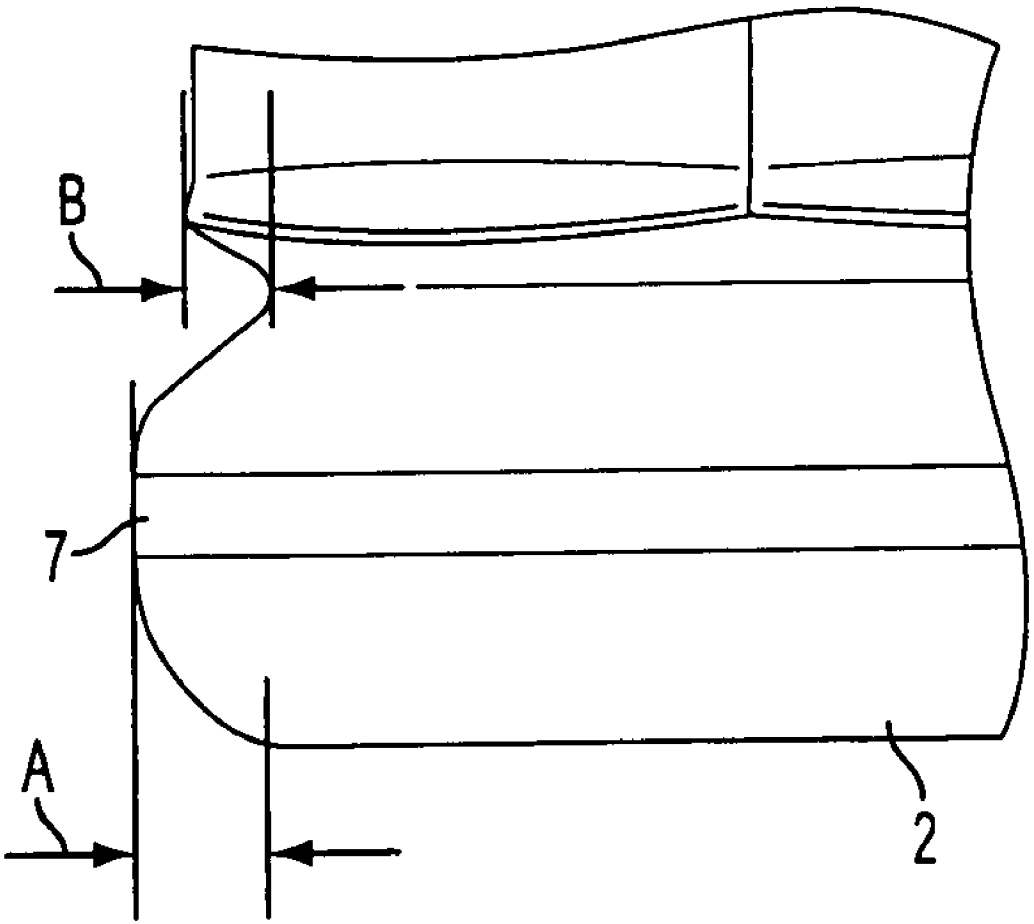
FIG. 3 is a detailed view of a base of an exemplary embodiment of the present invention.

FIG. 3 shows a more detailed view of an example of the second indented portion 17, but this figure and the following the description is equally applicable to the first indented portion 15. The second indented portion 17 may take the form of a concave ring that circumscribes the container. The ring is preferably formed in a plane that is perpendicular to longitudinal axis 100. For example, the indented portion can be a hoop ring that extends for 360 degrees around the container. The depth of the indented portion is preferably constant along the entire length of the ring. As can be seen from FIG. 3, second shoulder 7 projects from the longitudinal axis of the container to a greater extent than the panel 10. As the panel 10 may be curved, the depth of the second indented portion 17 with respect to the second shoulder 7 can vary along the panel 10. The second indented portion 17 is offset a first distance A from the second shoulder 7 and a second distance B from the support post at the junction between adjacent panels 10. The values for the first and second distances A, B can vary depending on the particular container design. In the embodiment illustrated, which is a 32 oz. container, first distance A is about 0.3 inches and second distance B is about 0.175 inches. The entire height of the container is about 5.9 inches and the panels 10 extend about 2.6 inches from their top edge 11 to their bottom edge 12.

Accordingly, the body 3 is substantially comprised of the flexible panels 10. The flexible panels 10 have an interior surface that is substantially smooth. That is, preferably no ribs, recesses or other structure are provided on an interior surface of the panel. An exterior surface of the panel 10 is also preferably substantially smooth. By minimizing geometry inside of the container and streamlining the body and interior surface of the container, the removal of a substance from the container is facilitated. First and second indented portions 15, 17 help maintain the circular shape of the container.

Figure 4:
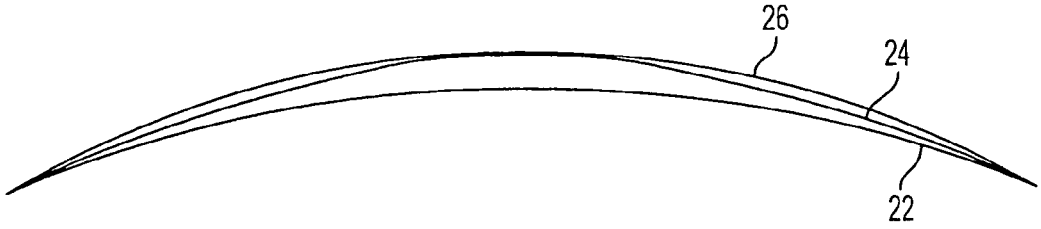
FIG. 4 depicts a longitudinal view of an exemplary embodiment of a flexible panel according to the present invention.

Flexible panel 10 preferably passes through at least three curves as it extends along the longitudinal axis 100 between the top portion 4 and the base 4 of the container 1. FIG. 4 is a view along the longitudinal axis 100 of the container 1 from the top portion 4 illustrating a first curve 22, a second curve 24, and a third curve 26 through which the flexible panel 10 passes. The first curve 22 has a first radius that is constant. The third curve 26 has a third radius that is also constant and greater than or equal to the first radius. The second curve 24 has a second radius that varies along the length of the second curve 24. As can be seen from FIG. 4, the radius of the second curve 24 varies, but maintains a value between the first radius and the third radius.

Figure 5:
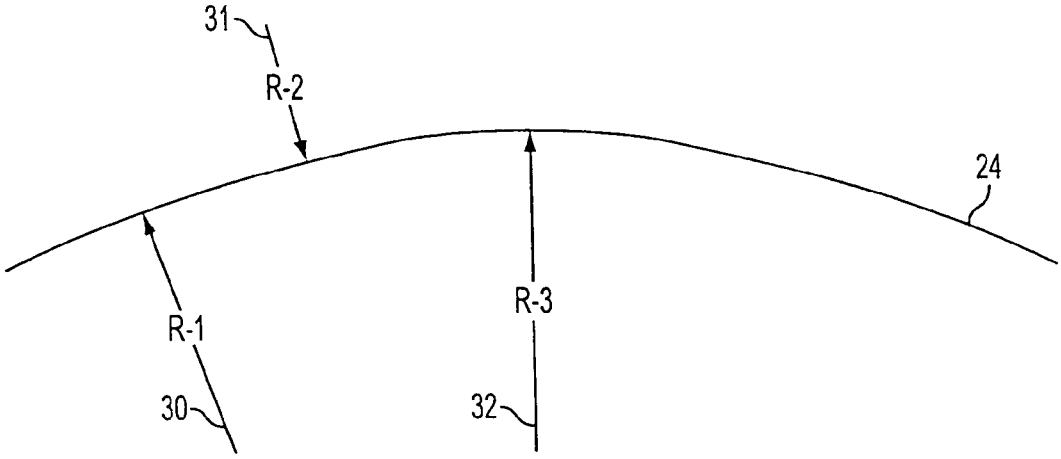
FIG. 5 depicts a detailed longitudinal view of an exemplary embodiment of a flexible panel according to the present invention.

FIG. 5 is a detailed view of the second curve 24. Second curve 24 is a compound curve comprised of a plurality arcs. Preferably at least three arcs, a first arc 30, a second arc 31 and a third arc 32, comprise the second curve 24. The first arc 30 is arranged at one end of the second curve 24 and preferably has a constant radius. The third arc 32 is arranged at a midpoint of the second curve 24, with the second arc 31 arranged between the first arc 30 and the third arc 32. The third arc 32 also preferably has a constant radius. The radius of the third arc 32 should be less than the radius of the first arc 30, and is preferably less than the radiuses of all other arcs comprising the second curve 24.

The second arc 31 may be slightly concave with respect to the first and third arcs 30, 32. A radius of the second arc 31 is typically very large and may approach infinity. Thus, the second arc 31 may appear almost linear. Although only the arcs on the left-hand side of second curve 24 are labeled in FIG. 4, the second curve 24 is preferably symmetrical and corresponding arcs are present on the right hand side of second curve 24.

The curves are called first, second, etc. for identification purposes. This terminology does not necessarily indicate a numerical order in which the flexible panel 11 passes through the curves.

Figure 6:
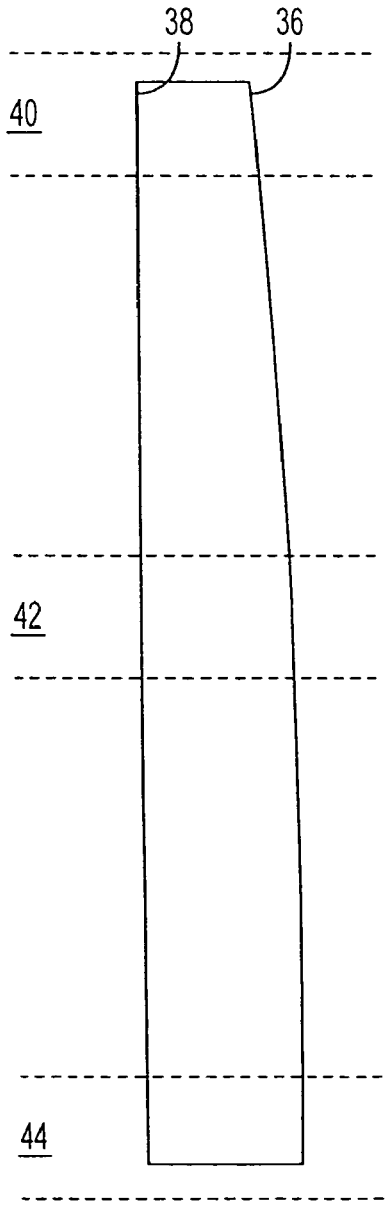
FIG. 6 depicts a side view of an exemplary embodiment of a flexible panel according to the present invention.

FIG. 6 shows a side view of a flexible panel 10 passing through the first, second and third curves. The flexible panel 10 includes an exterior surface 36 and an interior surface 38. The interior surface is preferably substantially planar as shown in the figure, although it may also be arcuate. The flexible panel 10 includes an initial portion 40, a middle portion 42 and a tail portion 44. The flexible panel 10 projects or arcs different distances from a plane defined by the longitudinal axis of the container 1. The projection of the panel increases along the longitudinal axis towards the base 2 of the container. The projection of the panel 10 from the plane of the longitudinal axis follows the first, second and third curves. The curves are transverse to the longitudinal axis 100 of the container. The flexible panel 10 passes through the curves between its side edges 13.

The initial portion 40 is arranged in the vicinity of the top portion 4 of the container 1. In at least part of the initial portion 40, the projection of the flexible panel 10 follows the first curve 22. The first curve 22 extends between the side edges 13 of panel 10. The projection of the flexible panel 10 follows the first curve 22 between side edges 13 and projects from the longitudinal axis of the container 1 according thereto.

The middle portion 42 is arranged below the initial portion 40. The amount of projection from the longitudinal axis in the middle portion 42 of the container is greater than the amount of projection in the initial portion 40 as shown in FIG. 6. In at least a part of the middle portion 42, the projection of the flexible panel 10 from the longitudinal axis 100 follows the second curve 24. The second curve 24 extends between the side edges 13 in the middle portion 42. The flexible panel 10 follows the second curve 24 and projects from the longitudinal axis of the container 1 according thereto.

The tail portion 44 is arranged below the middle portion 42. The projection of the panel 10 from the longitudinal axis in at least part of the tail portion 44 follows the third curve 26. The third curve 26 extends between the side edges 13 of the tail portion 44. The projection in the tail portion 44 follows the third curve 26 and projects from the longitudinal axis according thereto.

The flexible panel 10 preferably follows the first, second and third curves from one of its side edges 13 to the other side edge 13. At the side edges 13, the panel 10 is connected to an adjacent panel 10. The amount of projection from the longitudinal axis of the container in the tail portion 44 is greater than the amount of projection in either the initial portion 40 or the middle portion 42 before a hot-fill process.

By passing the flexible panel 10 through these three curves, a stronger panel 10 is attained. The varying radius of the panel 10 in the middle portion 42 provides strength to the panel 10. By strengthening this area, a means for the panel to retain its outward concavity is provided. This concave shape aids in simplifying the labeling process. Also, the shape of the panel provides rigidity. The panel can provide the structural support for the body, without the need for ribs, pillars or other support members.

For example, upon hot fill of the container, the middle portion 42 of the flexible panel 10 provides a stiff point which forces the tail portion 44 to move and change radius to accommodate the change in internal volume of the container. The tail portion 44 is compressed inwardly. This change in radius causes the tail portion 44 to become nearly the same in radius as the initial portion. Thus, the panel becomes almost symmetrical and maintains a convex shape.

Figure 7:
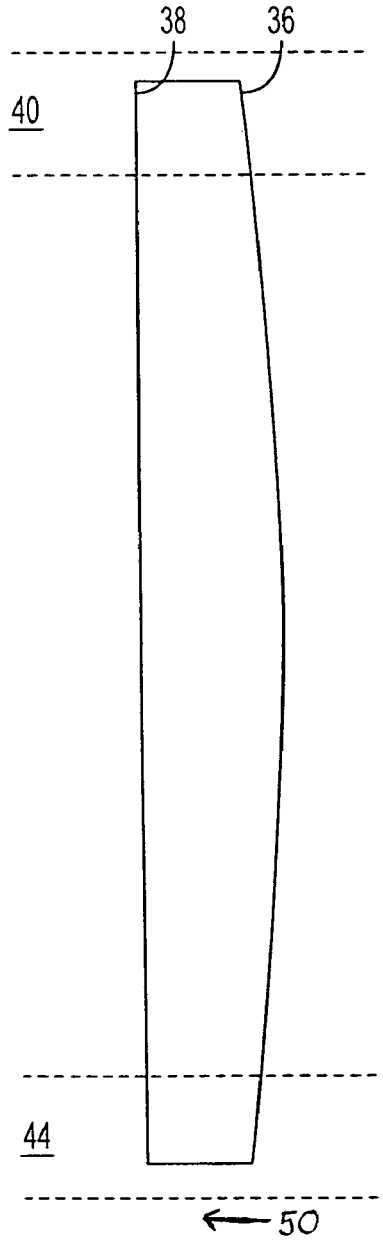
FIG. 7 depicts a side view of an exemplary embodiment of a flexible panel according to the present invention.

FIG. 7 is a side view of a flexible panel 10 that is in a deflected position due to applied vacuum pressure. The tail portion 44 of the container 1 deflects in the direction of arrow 50. The amount of deflection of tail portion 44 may vary. Tail portion 44 is preferably deflected such that it projects from the longitudinal axis of the container 1 an amount substantially the same as the initial portion 40. Thus, as shown in FIG. 7, the flexible panel 10 is substantially symmetrical about the middle portion 42.

It will be appreciated that the deflection of the tail portion 44 may progress steadily in response to the gradual contraction of the volume of the contents of the container 1 during cooling. This is in contrast to a panel which 'flips' between two states. The gradual deflection of the tail portion 44 to and from inversion in response to a relatively small pressure differential in comparison to panels which "flip", means that less force is transmitted to the side walls of the container 1. This allows for less material to be necessarily utilized in the container construction, making production cheaper. Consequentially, less failures under load may occur for the same amount of container material.

Furthermore, the reduced pressure differential required to deflect the projecting portion 44 allows for a greater number of panels 10 to be included on a single container 1. Thus, the panels 10 do not need to be large in size, or reduced in number on a container structure, providing more flexibility in container design.

A container having a body comprised of six or more panels allows for a wider variety of labeling options. The body of the container typically receives some type of label that identifies and provides information about the contents of the container. A six-sided container provides a substantially circular labeling surface and provides an overall package that is substantially smooth. Also, the circular shape allows for a continuous wrap label to be applied. Coupled with the outwardly bowed panels, the smooth shape allows for a great variety of labeling options including heat transfer labels, pressure sensitive labels, or a more robust application of more traditional labels.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A container having a central longitudinal axis, the container comprising:

a plurality of deflectable panels, each of the deflectable panels projecting from the longitudinal axis to pass through at least three curves including a first curve having a first constant radius, a second curve having a second varying radius, and a third curve having a third constant radius that is greater than the first radius wherein the deflectable panel has no reinforcement ribs or grooves; and at least one indented portion with respect to the deflectable panel arranged adjacent to and above or below the deflectable panels.

2. The container of claim 1, wherein the second curve is comprised of a plurality arcs.

3. The container of claim 2, wherein the second curve includes an arc at its midpoint with a radius which is smaller than the radiuses of all other arcs in the second curve.

4. The container of claim 1, wherein the second varying radius is greater than the first constant radius.

5. The container of claim 1, wherein the second varying radius is less than the third constant radius.

6. The container of claim 1, further comprising more than four deflectable panels.

7. The container of claim 1, wherein there are six deflectable panels arranged adjacent to each other around the perimeter of the container.

8. The container of claim 1, wherein the indented portion extends for 360 degrees around a perimeter of the container.

9. The container of claim 8, wherein the indented portion is disposed above each of the deflectable panels.

10. The container of claim 8, wherein the indented portion is disposed below each of the deflectable panels.

11. A container, comprising:

an enclosed base portion;

a body portion extending upwardly from the base portion, the body portion having a central longitudinal axis and including a plurality of active surfaces;

a top portion with a finish extending upwardly from the body portion;

a support portion arranged between one of the body and the top portion, and the body and the base portion, the support portion being offset towards the central longitudinal axis with respect to at least one of the active surfaces, wherein the active surfaces include an initial region that passes through a first curve having a first constant radius, a middle region arranged below the initial region and that passes through a second curve having a second varying radius, and a tail region arranged below the middle region and that passes through a third curve having a third constant radius that is greater than the first constant radius and wherein after cooling the third radius becomes nearly the same as the first radius.

12. The container of claim 11, wherein the support portion circumscribes the body.

13. The container of claim 11, further comprising two support portions, a first support portion disposed between the body and the top portion and a second support portion disposed between the body and the base portion.

14. The container of claim 11, wherein the support portion is a ring indented about 0.300 inches from an outermost portion of the base portion.

15. The container of claim 11, wherein the support portion extends for 360 degrees around the container.

16. The container of claim 11, wherein the support portion is a ring disposed in a plane perpendicular to the longitudinal axis.

17. The container of claim 11, wherein the body portion comprises more than four active surfaces.

18. The container of claim 11, wherein a cross-section of the body portion in a plane perpendicular to the longitudinal axis is substantially circular.

19. The container of claim 11, wherein the active surface accommodates a vacuum-induced volumetric shrinkage of the container resulting from a hot-filling, capping and cooling thereof.

20. The container of claim 11, wherein of the active surface is smooth.

21. The container of claim 11, wherein the active surfaces have side edges arranged opposite each other, the side edges of each active surface being connected to side edges of an adjacent active surface.

22. The container of claim 21, further comprising a support post formed at a junction between the side edges.

23. The container of claim 22, wherein the support portion is indented about 0.175 inches from the post.

24. A container, comprising:

an enclosed base portion;

a body portion extending upwardly from the base portion, the body portion having a central longitudinal axis and including at least six deflectable panels, the deflectable panels having side edges extending in the direction of the longitudinal axis;

a top portion with a finish extending upwardly from the body portion;

a first indentation disposed between the body portion and the top portion and extending for 360 degrees around the container, the first indentation being offset towards the central longitudinal axis with respect to the deflectable panels; and a second indentation disposed between the body portion and the base portion and extending for 360 degrees around the container, the second indentation being offset towards the central longitudinal axis with respect to the deflectable panels the deflectable panel having an exterior surface and an interior surface and projecting from the longitudinal axis to pass through at least three curves including a first curve having a first constant radius, a second curve having a second varying radius, and a third curve having a third constant radius that is lesser than the first radius, wherein an entire area of the interior surface is substantially smooth.

25. A container of claim 24, further comprising support posts disposed at the side edges of the deflectable panels and joining each side edge of each panel to a side edge of another panel.

26. The container of claim 24, wherein the deflectable panels extend between the first indentation and the second indentation.

27. The container of claim 24, the top portion having a first shoulder adjacent to the body portion and the first indentation being offset towards the central longitudinal axis with respect to the shoulder.

28. The container of claim 27, wherein the shoulder projects from the longitudinal axis to a greater extent than the deflectable panels.

29. The container of claim 27, wherein the first indentation merges with the first shoulder.

30. The container of claim 24, the base portion having a shoulder adjacent to the body portion and the second indentation being offset towards the central longitudinal axis with respect to the shoulder.

31. The container of claim 30, wherein the second indentation merges with the shoulder.

32. The container of claim 24, wherein the body portion has a substantially circular cross-section in a plane perpendicular to the longitudinal axis.

33. The container of claim 24, wherein the deflectable panels include a top edge that merger with the first indentation and a bottom edge that merges with the second indentation.

34. The container of claim 24, wherein the side edges of each deflectable panel are coupled to side edges of another deflectable panel.

35. The container of claim 24, wherein the first and second indentations are rings formed in planes perpendicular to the longitudinal axis.

* * * * *